United States Patent [19]

Perez

[11] 4,283,051

[45] Aug. 11, 1981

[54] POLICE NIGHT STICK

[76] Inventor: Sergio J. Perez, 311 W. 97th St., Apt. 3-E, New York, N.Y. 10025

[21] Appl. No.: 120,485

[22] Filed: Feb. 11, 1980

[51] Int. Cl.[3] ..... F41B 15/06

[52] U.S. Cl. ..... 273/84 R

[58] Field of Search ..... 273/84 R; D22/1, 2; 16/110.5; 30/151, 162; 43/6; 81/3.35, 3.36; 132/76.2, 90; 224/914; 294/61

[56] References Cited

U.S. PATENT DOCUMENTS

| | | | |
|---|---|---|---|
| D. 230,150 | 1/1974 | Anderson | 273/84 R |
| 634,466 | 10/1899 | Laird | 30/162 X |
| 683,030 | 9/1901 | Fidjeland | 30/162 X |
| 909,129 | 1/1909 | Ricks | 294/61 X |
| 1,209,169 | 12/1916 | Komadina | 43/6 X |
| 1,716,131 | 6/1929 | Hodgson | 273/84 R X |
| 2,966,621 | 12/1960 | Voll | 273/84 R X |
| 2,989,334 | 6/1961 | Browne | 294/61 X |
| 3,385,601 | 5/1968 | Black | 273/84 R |
| 3,554,546 | 1/1971 | Brauhut | 273/84 R |
| 3,803,742 | 4/1974 | Foster | 43/6 X |

FOREIGN PATENT DOCUMENTS

| | | | |
|---|---|---|---|
| 559747 | 3/1944 | United Kingdom | 273/84 R |
| 595879 | 12/1947 | United Kingdom | 273/84 R |

*Primary Examiner*—Richard J. Apley

[57] ABSTRACT

A policeman's night stick which includes a handle along its side; with a slot for receiving the fingers; a needle retractably extendable from one end of the night stick; a tethered ring for receiving a thumb of a hand, rested around the stick when clipped on a policeman's belt, and a tethered whistle for summoning help when needed.

1 Claim, 7 Drawing Figures

10
11
12
12a
13
14
14a
15
17
18
19
20
21
22
23
24
4
5

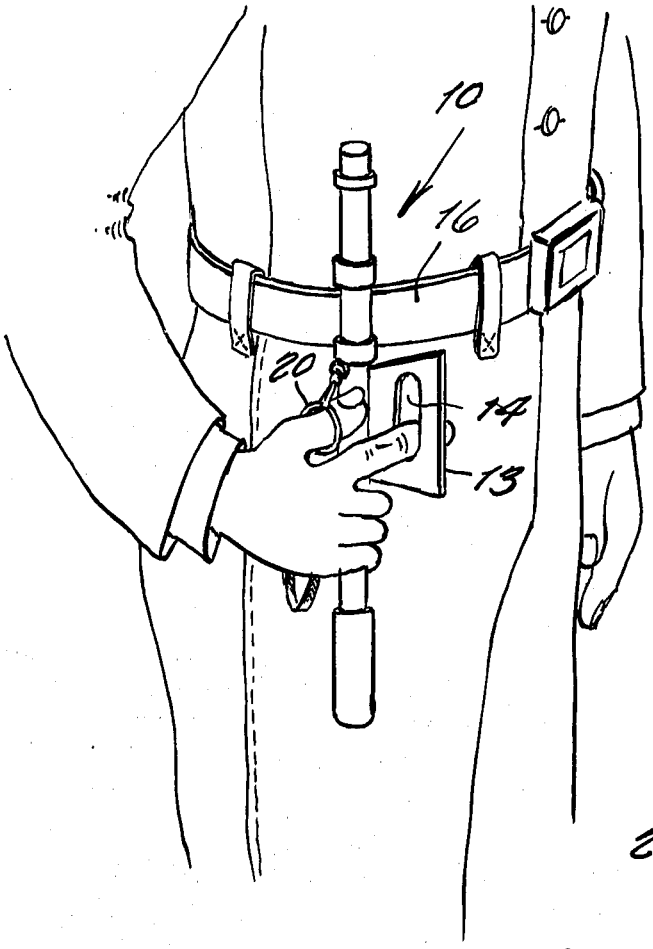
Fig. 6
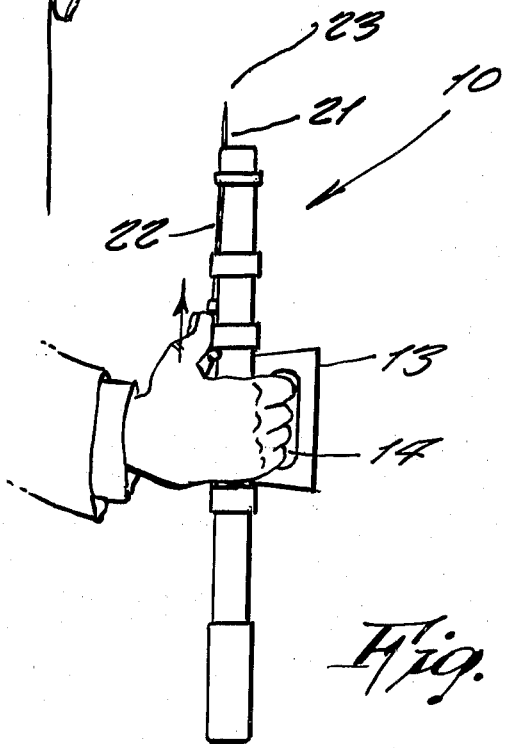
Fig. 7
Fig. 5
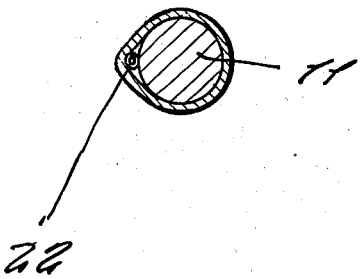

POLICE NIGHT STICK

SUMMARY OF THE INVENTION

This invention relates generally to billy clubs or night sticks, such as are carried by uniformed policeman patrolling on foot.

It is well known that a conventional night stick comprises a wooden club having a thong attached thereto for selective swinging thereof from a hand; and the club being clipped to a police patrolman's belt when being worn. However, such night sticks are not sufficient for controlling law breakers in these times of increased physical violent crimes.

Therefore, it is a principal object of the present invention to provide an improved policeman's night stick which additionally includes a rigid loop-type handle along its side, so that when the fingers of a hand are inserted therethrough, the night stick cannot be forcibly pulled away by a criminal struggling with a policeman; and wherein the butt of the handle can be used either for striking or as a pressure bar against the body of an unsubdued individual.

Another object is to provide an improved night stick that includes a retractable needle on its end for use in attempting to subdue a violent person or wild mobs.

BRIEF DESCRIPTION OF THE DRAWING

FIG. 5 is a cross sectional view on line 5—5 of FIG. 2 showing the needle and needle sheath inside the collar.

FIG. 6 shows the night stick clipped on a belt and a hand gripped around the club, while the thumb is rested in the ring and a forefinger is in the handle slot.

FIG. 7 shows a position of a hand around the night stick while a thumb has pushed up the needle.

PREFERRED EMBODIMENT

Figures 1, 2, 3, 4:
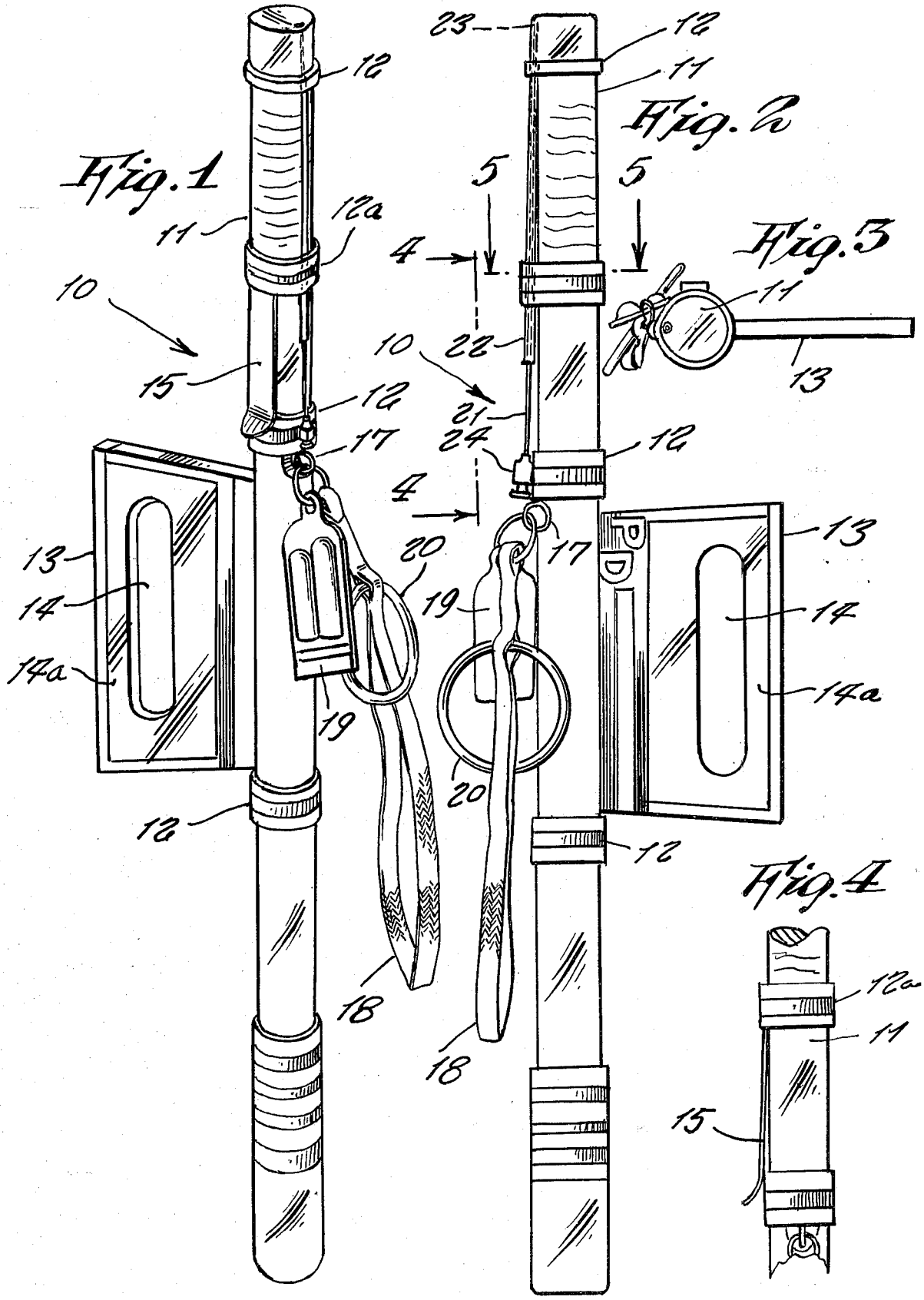
FIG. 1 is a perspective view of the invention.
FIG. 2 is a side view thereof.
FIG. 3 is a top end view.
FIG. 4 is a fragmentary side view as viewed on line 4—4 of FIG. 2

Referring now to the drawing in greater detail. The numeral 10 represents an improved policeman's night stick according to the present invention. Wherein there is a straight cylindrical club 11 made of suitable material and which includes decorative collars 12 therearound at various places throughout its length.

A handle 13 made of hard plastic is mounted on a side of the club and approximately midway between the opposite end; the handle having a slot 14 therethrough for receiving fingers wrapped around the bar 14*a* of the handle. A steel leaf spring clip 15 secured at one end under one of the collars 12*a* rests along-side the club, and serves to clip on a belt 16 worn by a policeman.

An eyelet 17 affixed to the club on a side opposite the handle, supports a conventional thong 18 and a whistle 19 by being tethered thereto. A metal ring 20 large enough to receive a thumb is tethered along the thong.

A steel needle 21 is slidable in a metal tubular sheath 22 mounted along a side of the club; the needle is retractable, its point 23 does not extend beyond the end of the club. As shown in FIG. 2, when the needle isretracted, a knob 24 on the other end of the needle is located conveniently for a thumb of a hand holding the club, to push the needle so that the needle point is protruded beyond the club's end, as shown on FIG. 7, in order to be used in combat against an attacker.

It is understood that changes maybe made in the design, according to the limits of the appended claims.

I claim:

1. An improved policeman's night stick, comprising in combination; an elongated, cylindrical, rigid, straight club portion; a rigid, hard plastic handle mounted on a first surface portion of said club portion and being upwardly directed therefrom; said handle being located approximately midway between the ends of said club portion; a metallic, tubular sheath; means mounting said sheath to a second outer surface portion of said club portion at the forward end thereof; said second surface portion being opposite to said first surface portion; a steel needle being slidably received in said sheath; the operative end of said needle being tapered to a point and being in a normally retracted position within said sheath when not in use; the opposite end of said needle being located adjacent to said handle and having finger engaging means which the policeman engages to slide said needle within said sheath and expose said operative end beyond the forward end of said club portion; a spring clip mounted on the outer surface of said club portion for attachment to the policeman's belt; and a whistle and thong tethered to said club portion.

* * * * *